US005885149A

United States Patent [19]

Gillet et al.

[11] Patent Number: 5,885,149

[45] **Date of Patent: *Mar. 23, 1999**

[54] HOMOGENOUS ABRASIVE TOOL

[76] Inventors: Thierry Gillet, avenue Paul Janson 92, 1070 Brussels; Theodore Holsteyns, Sportstraat 23, 3530 Helchteren, both of Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 680,378

[22] Filed: Jul. 15, 1996

[51] Int. Cl.[6] ..... B24B 33/02; C09K 3/14

[52] U.S. Cl. ..... 451/546; 51/298; 51/309; 451/541; 451/548; 125/15

[58] Field of Search ..... 51/295, 297, 298, 51/299, 293, 300, 307, 309; 125/12, 15, 13.01, 36, 39; 451/526, 527, 530, 532, 534, 540, 541, 544, 546, 548

[56] References Cited

U.S. PATENT DOCUMENTS

| | | | |
|---|---|---|---|
| 2,143,636 | 1/1939 | Tone | 451/544 |
| 2,413,729 | 1/1947 | Rushmer | 451/546 X |
| 3,262,231 | 7/1966 | Polch | 451/546 |
| 3,293,012 | 12/1966 | Smiley et al. . | |
| 3,427,759 | 2/1969 | Kistler et al. | 451/546 |
| 3,574,579 | 4/1971 | Clarke et al. . | |
| 3,650,715 | 3/1972 | Brushek et al. . | |
| 3,664,819 | 5/1972 | Sioui et al. . | |
| 3,779,726 | 12/1973 | Fisk et al. | 51/295 |
| 3,841,852 | 10/1974 | Wilder et al. . | |
| 3,896,593 | 7/1975 | Rine | 451/546 X |
| 4,067,312 | 1/1978 | Tessner . | |
| 4,350,497 | 9/1982 | Ogman | 451/546 X |
| 4,945,687 | 8/1990 | Scheider et al. | 451/534 X |
| 5,176,055 | 1/1993 | Wijesinghe et al. . | |
| 5,244,371 | 9/1993 | Bello et al. . | |
| 5,316,559 | 5/1994 | Klievoneit et al. . | |
| 5,651,729 | 7/1997 | Benguerel | 451/544 X |

FOREIGN PATENT DOCUMENTS

| | | |
|---|---|---|
| 2655904 | 6/1991 | France . |
| 1236396 | 3/1967 | Germany . |
| 61-274203 | 4/1987 | Japan . |
| 972835 | 10/1964 | United Kingdom . |

*Primary Examiner*—Timothy V. Eley
*Attorney, Agent, or Firm*—Shook, Hardy & Bacon; Joseph B. Bowman

[57] ABSTRACT

An abrasive tool and a method for its manufacture is provided in which the structural body of the tool, including both the central core and the outer, abrasive-containing portion, is fabricated of a homogeneous material, with abrasive particles dispersed throughout the consumable abrasive-containing portion to grindingly remove workpiece material during rotation of the structural body. A porous lattice of diamond grains encased in a cladding material is first formed by sintering as a continuous annulus or as arcuate segments. The skeletal lattice is then placed in a mold and a homogeneous material in liquid state is introduced into the mold to simultaneously form the central core and to flow into at least a portion of the porous lattice of clad diamond grains to provide an integrally molded, unity tool when the core material solidifies.

28 Claims, 3 Drawing Sheets

HOMOGENOUS ABRASIVE TOOL

This application is a continuation in part application of PCT/BE95/00101 filed Nov. 6, 1995, which claims priority to Belgium Filing No. 09401028 filed Nov. 16, 1994. This application also claims priority to Belgium Filing No. 09600432 filed May 13, 1996. The foregoing applications are incorporated herein by reference.

BACKGROUND OF THE INVENTION

This invention relates to an abrasive tool for cutting, sawing, boring, grinding and similar material removal operations. More particularly, the invention relates to an abrasive impregnated tool such as a saw blade, core bit, grinding wheel or shaping tool, and the method for making such abrasive tools.

Abrasive tools, such as saw blades for example, are known to have hardened particles embedded in the outer rim to cut extremely hard surfaces, such as concrete, masonry, metallic materials and the like. These tools are typically formed with a steel core and a continuous or segmented rim formed of metal powders and a mixture of hardened particles, such as diamond, cubic boron nitride, tungsten carbide, polycrystalline diamond, and polycrystalline cubic boron nitride, most often referred to simply as a "diamond" segment.

In the process for manufacturing the diamond containing rim, a metal powder and diamond grit mixture may be hot pressed at high temperatures to form a solid metal alloy known in the industry as a "matrix" in which the diamond grit is dispersed. The diamond containing rim, fabricated either as a continuous annulus or as arcuate segments, must then be securely fixed to the central core or disc to form the saw blade. In the prior art, the composition of the metal forming the matrix is different from the metal forming the core. The circular core for a diamond saw blade is characteristically precision-made steel for strength and rigidity. The matrix metal, on the other hand, is intentionally consumable so that fresh diamond chips will continuously become exposed to aid in the cutting or grinding operation.

To attach the diamond rim or segments securely to the steel core, several different processes have been used in the past. In a brazing operation, silver solder is placed between the diamond segment and the core. At high temperatures, the solder melts and bonds the two parts together. Alternatively, the diamond segment and steel core can be fused together by an electron beam or laser beam. Mechanical bonds are also known in which a notched, serrated or textured blade core may be used along with brazing or other metallurgical bonding processes to lock the diamond rim or segments onto the core.

As a result of the extreme conditions and applications of abrasive tools in cutting hard substances such a rock, concrete, tile and masonry products, numerous problems have been encountered relating to cutting efficiency, tool life and operator safety. Overheating of the abrasive tool and the differences in the thermal properties of the diamond-containing matrix from the structural core of the tool seem to explain many of the difficulties which are experienced.

Techniques have been developed for manufacturing diamond blades which attempt to facilitate heat dissipation. These blades are separable into two primary types, blades formed with a continuous outer rim and blades formed with a segmented outer rim. Continuous rim blades are used in applications where chipping is critical, but blade speed is not, such as when cutting tile. Overheating of the continuous rim blade can result in cracking of the rim, excessive wear, distortion of the blade shape, and a safety threat if any portion of the blade breaks away. The continuous rim may therefore to manufactured in a castellated shape, such as a trapezoidal or square wave form when viewed on edge, to space apart successive portions of the diamond containing rim for heat dissipation and thermal expansion.

Segmented rims are typically used in applications where chipping is not critical, but blade speed is critical, such as when cutting concrete. As the blade speed increases, the operating temperature increases significantly. When sufficiently heated, the outer diamond segments will expand. The core may therefore be manufactured with notches between the segments to permit the segments to expand into the notches and to facilitate removal of material from the cut. Overheating of the segmented blade can result in excessive wear, segment cracking, breaking the bond between the segment and the core, loss of the segment and a safety threat to workmen.

The previously described principles of abrasive tool construction and manufacturing techniques are exemplified in the following prior patents.

To construct a continuous rim blade, one method (U.S. Pat. No. 3,369,879) has been proposed in which an annular grinding member is affixed to a copper ring which is affixed to a steel core of the blade. The steel core is centered within a mold, the core's perimeter is coated with solder, the copper ring is pressed onto the core and bonded thereto with the solder. Next, a mixture containing diamond particles is poured into a cavity in the mold surrounding the copper ring. After the mold is closed, heat and pressure are applied to the mixture to "hot press" the rim. This combination of heat and pressure forms a rigid grinding rim and secures the outer rim to the copper ring.

Alternative methods have been proposed for bonding the abrasive rim to the central core (U.S. Pat. No. 2,189,259; U.S. Pat. No. 2,270,209 and Reissue U.S. Pat. No. 21,165). In the method of the '259 patent, the core and the outer rim are separately poured into respective central and outer cavities of a mold. These cavities are separately closed and then aligned with one another and heated and compressed to hot press to the outer rim onto the core. In the method of the '209 patent, a steel central core is centered in the mold and the outer rim mixture is poured into a cavity surrounding this steel core. The mixture is hot pressed directly onto the core. In the method of the '165 reissue patent, the abrasive rim is welded or soldered to the central core.

As to the second type of blades, previous methods (U.S. Pat. No. 3,590,535) have been proposed to construct segmented outer rims. In the method of the '535 patent, a plurality of diamond bearing outer segments are formed from a mixture of diamond dust, copper powder and tin powder. Each outer segment is separately press molded onto a corresponding steel underlying segment. The steel underlying segments are machined to fit the contour of the core and subsequently welded thereto.

In an alternative method (U.S. Pat. No. 3,048,160) a blade for cutting hard materials is formed by initially molding a plurality of abrasive cutting segments. As originally formed, each segment includes a serrated bottom surface which is welded to the perimeter of the core by heating and applying radial pressure against an outer surface of each segment. An alternative method (U.S. Pat. No. 2,818,850) has been proposed in which the cutting segments are hot pressed such that the included diamond dust is concentrated near the outer surface of the cutting segment. Once hot pressed, an inner surface of the cutting segments are ground to provide a curved surface thereon which substantially corresponds to the outer arc of the blade core. Next, each segment is brazed to the disc core.

However, each of the above methods has only met with limited success. As to the latter group of methods, which separately fasten multiple segments to the core, each of these methods require separate manufacturing and repeated handling of each segment. Next, each segment must be deburred along its outer surface and ground along its inner surface to form a concave surface thereon, the radius of which substantially corresponds to that of the steel core. Then, each segment must be separately bonded to the core.

Further, this latter group of methods experience extreme difficulty in bonding each segment to the steel core. The diamonds within each segment interfere with this bonding process. To overcome this problem, the '535 patent uses an underlying diamond face or backing layer molded to the diamond section and welded to the core. The '160 patent forms a serrated surface on each segment to effect bonding. The '850 patent utilizes a special molding technique to concentrate the diamond segments proximate the rim's outer surface.

The outer rims also create problems during the welding process due to the presence of the copper and diamond particles. When a welding beam contacts a copper particle, it is partially reflected and consequently less effective at heating the region of the abrasive segment surrounding the copper particle. Also, if the temperature of the welding beam is excessive and the beam contacts a diamond particle, the beam causes carbonization of the diamond particle. Ultimately, the carbonized diamond particle detaches from the segment. Diamond particles within the back side of each segment inhibit the radiusing process in which the concave surface on each segment is machined to match the core. To minimize the effects of the diamond particles upon the grinding and welding processes, a bonding or backing material is formed along the back side of the diamond segment. This backing material is easily ground to the desired radius and easily welded to the core.

Further, diamond blades formed by methods within the former group are void of notches within the core. These notches reduce heating of the blade and help clear foreign particles from the cut during operation. Consequently, blades formed by methods within the former group have more limited applications. As previously mentioned, if overheated, the continuous rims expand, crack and often fail.

In addition to the foregoing tool configurations to alleviate heat related problems, operating methods may influence heat dissipation. The use of water to cool the outer, cutting portion of abrasive tools has long been known as one method to help minimize overheating and the attendant dangers to personnel and damage to equipment. Of course, the use of water is not always an acceptable option and represents its own set of safety concerns and potential property damages.

Heretofore, it has been impossible to construct a rotatable abrasive tool without separately forming and then securely attaching the abrasive-containing rim or segments to the central core. The need remains in the industry for an economical, safe and long lasting rotatable abrasive tool and for an improved method for manufacturing abrasive tools having these characteristic. The primary goal of this invention is to meet these needs, and to overcome the drawbacks previously experienced.

SUMMARY OF THE INVENTION

More specifically, an object of the invention is to provide an abrasive tool for which the core and the abrasive-containing portion are integrally formed of the same homogeneous material to permit successful cutting and grinding at cooler operating temperatures than previously known in the industry.

Another object of the invention is to provide an abrasive tool for which the core and the abrasive-containing portion are integrally formed of the same homogeneous material to reduce mechanical stresses within the tool and thereby improve tool life.

Another object of the invention is to provide an abrasive tool of the character previously described to greatly reduce, if not eliminate completely, the possibility of large pieces of the tool becoming detached during use to represent a significant safety threat.

It is a further object of the invention to provide an improved method for manufacturing abrasive tools which eliminates the expensive, time consuming and tedious step of separately brazing, welding, or otherwise mechanically bonding an abrasive rim or segment to a rotatable core member.

Yet another object of the invention is to provide an improved manufacturing process for abrasive tools in which the core and the abrasive-containing portion of the tool are formed at the same time with the same material to provide a unitary structure with improved operating characteristics.

In summary, an abrasive tool and a method for its manufacture is provided in which the structural body of the tool, including both the central core and the outer, abrasive-containing portion, is fabricated of a homogeneous material, with abrasive particles dispersed throughout the consumable abrasive-containing portion to grindingly remove workpiece material during rotation of the structural body. In the manufacture of the novel abrasive tool, a porous lattice of diamond grains encased in a cladding material is first formed by sintering as a continuous annulus or as arcuate segments. This skeletal lattice is then placed in a mold at appropriate locations to provide the cutting and grinding layer of the abrasive tool when completed. A homogeneous material in liquid state is then poured into the mold to simultaneously form the central core and to flow into at least a portion of the porous lattice of clad diamond grains to provide an integrally molded, unity tool when the core material solidifies.

Other and further objects of the invention, together with the features of novelty appurtenant thereto, will appear in the course of the following description.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

An rotatable abrasive tool is provided in which the structural body of the tool, including both the central core and the outer, abrasive-containing portion, is fabricated of a homogeneous material, with abrasive particles dispersed throughout the consumable, abrasive-containing portion to grindingly remove workpiece material during rotation of the structural body. Thus, the abrasive tool may be in the form of a saw blade, drill bit, grinding wheel, shaping tool or related material removal tool. As an illustrious example, a diamond saw blade constructed in accordance with the invention is shown in FIGS. 1 through 8.

Figure 1:
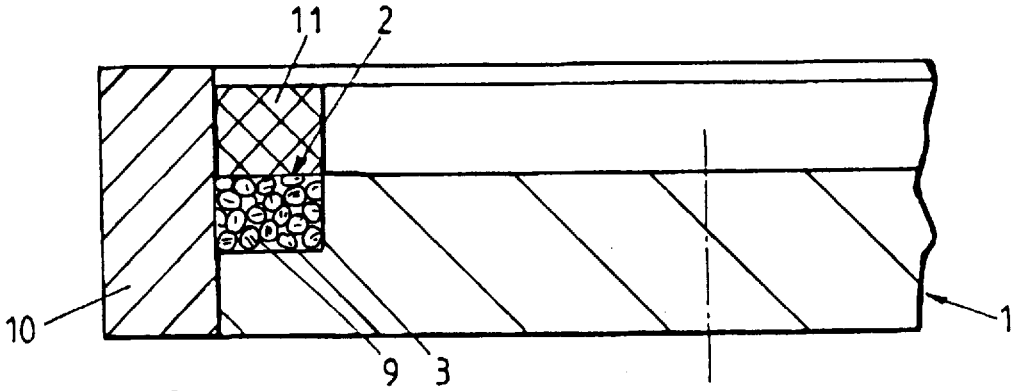
FIG. 1 is a cross-sectional and partial schematic view of a sintering mold used in positioning grains of diamond to form a porous skeletal lattice.
Figure 2:
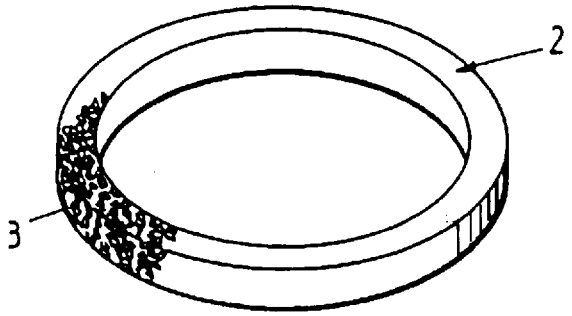
FIG. 2 is a perspective view of a porous annular structure diagrammatically illustrating over part of its length the positioning of the grains of diamond.
Figure 5:
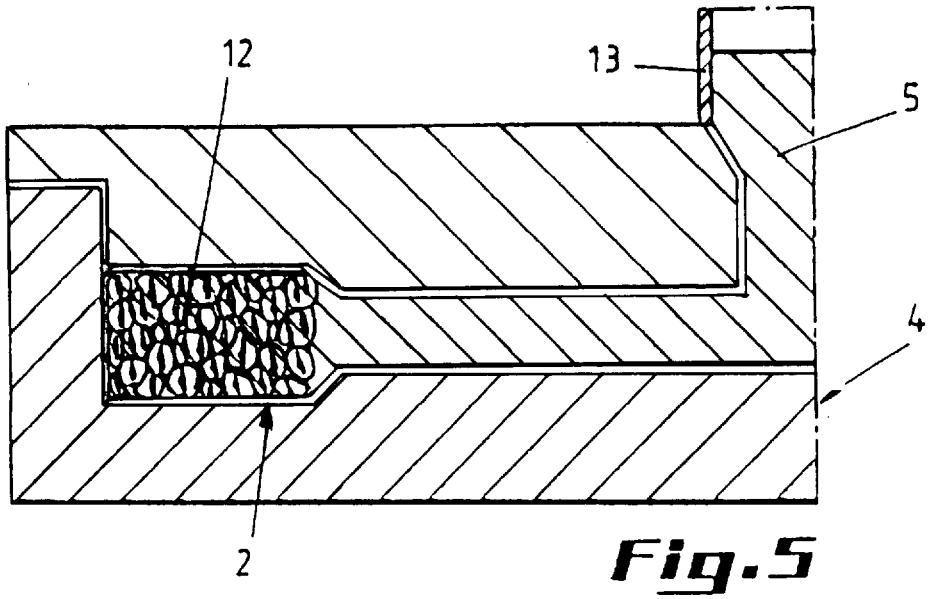
FIG. 5 is a cross-sectional schematic view of a casting mold containing an abrasive tool formed from a porous lattice of clad diamond grains and a homogeneous material to provide a unitary construction.

Referring first to FIGS. 1 & 2, a porous lattice 2 of diamond grains 3 held by a cladding material 8 is first formed by sintering as a continuous annulus or as arcuate segments. This skeletal lattice or diamond-loaded structure 2 is then placed in a mold 4 as shown in FIG. 5 at appropriate locations to provide the cutting layer of the saw blade when completed. A homogeneous material 5 in liquid state is then poured into the mold 4 to simultaneously form the central core 6 and to flow into at least a portion of the porous lattice of clad diamond grains to provide an integrally molded, unity tool when the core material 5 solidifies.

Figure 3:
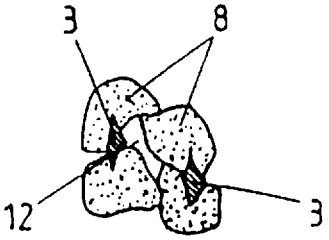
FIG. 3 is a fragmentary view of FIG. 2, on a much larger scale, showing a detailed view of clad diamond grains positioned in porous lattice structure according to an initial embodiment of the invention.
Figure 4:
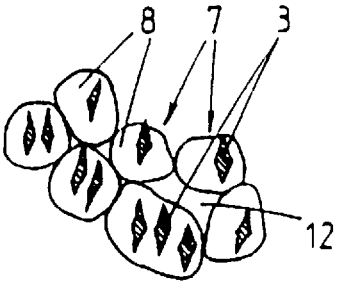
FIG. 4 is a fragmentary view, on a larger scale, showing a second embodiment of the positioning of clad diamond grains in the porous lattice structure as illustrated in FIG. 2.

To this end, as shown in FIGS. 3 and 4, the lattice structure 2 is in the form of a skeleton comprising open pores 12 between adjacent diamond grains 3 held by the cladding 8. The volume of the void represented by the open pores 12 or interstitial region preferably represents at least 30% to 75% of the total volume of the lattice structure made up of the pores 12, cladding 8 and diamond grains 3. Although the pores 12 themselves are irregular in form, if expressed as a nominal diameter, then the average diameter of the pores 12 range between 100 and 500 microns, with a maximum diameter of 2 mm.

A homogeneous material 5 forms the central core of the tool and penetrates the open pores 12 between the diamond grains 3 and cladding 8 sufficiently to form a unitary construction. It is desirable that the core or support material 5 penetrates at least 70% of the void volume.

Advantageously, the support material 5 has a melting point above the normal service temperature of the tool and below 1200° C. The support material requires a melting point sufficiently above the service temperature of the abrasive tool to prevent any deterioration or distortion of the tool during its use. In addition, according to the invention, the melting point of the support material 5 must be below 1200° C. in order to safeguard the penetration of this material into the pores 12 of the skeletal lattice without any risk of deterioration of the grains of diamond incorporated in the diamond-loaded structure. Most preferably, the support material 5 has a melting point below 950° C. for greatest safety to the integrity of the diamond grains.

Thus, a suitable support material 5 may be a metal substance essentially based on one or more of the following elements: cobalt, iron, zinc, tin, aluminum, magnesium, copper or silicon, or an alloy of these elements. Excellent results have been obtained with an abrasive tool whose support metal is formed from an aluminum-silicon alloy containing 5–9% by weight silicon, preferably of the order of approximately 7% by weight.

Alternatively, a suitable support material 5 may be based on high performance polymers of the polyimide, polysulphone or PEEK (polyether ester ketone) type, polyesters or epoxies. When the core 6 is formed from a less sophisticated polymer, such as polyesters or epoxy, then it may be necessary to reinforce with glass, aramide or carbon fibers.

It will be understood that whether the homogeneous support material 5 is metal or polymer based, a reinforcing material, such as glass, aramide, carbon, or metal in a preformed state as a mat, threads, fibers or the like, may be included in the central core portion of the tool for added strength and rigidity.

As previously mentioned, the diamond grains 3 are preferably held in a cladding material 8. The cladding 8 must have a melting point greater than the melting point of the support material 5. If the homogeneous support material 5 of the core 6 is metal, then the abrasive cladding material 8 may be essentially based on one or more of the following: cobalt, iron, bronze, nickel, titanium, copper, zinc, mixtures and alloys thereof, and ceramic coatings such as aluminum oxide. If the homogeneous support material 5 is a metal with a low melting point, such as aluminum, copper, zinc or their respective alloys such as alpax (i.e., alloys of aluminum and silicon), bronze, brass or zamak (i.e., alloys of zinc and silicon), or a high performance polymer of the polyimide, polysulphone or PEEK type, then the coating material 8 may be either metallic as indicated previously, or based on polymers or liquid crystals with high thermo-mechanical performance, such as polyimides, polysulphones or PEEK.

Within the lattice or diamond-loaded structure 2, the diamond grains 3 comprise from 1% to 50% by volume for an adequate working range, comprise from 1% to 15% by volume for a preferred concentration range, and comprise approximately 3% by volume in an advantageous commercial embodiment. The size of diamond grains or chips applicable for use in this invention vary considerably. However, in the building and industrial trades to which the invention is particularly important, the diamond grains are generally of a size ranging from 20 to 80 US-MESH (ISO standard 6106/FEPA or ANSI B74-16), and preferably between 30 and 60 US-MESH.

In some cases, the diamond-loaded structure 2 may be doped with grains of additive abrasive material, such as grains of silicon, tungsten or titanium carbide; silicon or aluminum oxide; or mixtures thereof. Such additive abrasives, however, should be no more than ten times the volume of the quantity of the grains of diamond.

As an alternative embodiment, the diamond-loaded structure 2 may be formed as an extruded flexible thread or rope. Such a structure can be obtained by extrusion of metal powders or other pre-mixes with grains of diamond and with a plasticizer allowing passage through suitable dies. During the manufacture of the abrasive tool, one or more diamond-loaded threads or ropes may be shaped as necessary and placed in the tool mold. Heat vaporizes the plasticizer material to then provide the void spaces throughout the diamond structure which will be filled by the homogeneous material as previously indicated.

The invention also concerns a particular process for making abrasive tools having the aforementioned characteristics.

This process is characterized by the steps of forming an annual structure or arcuate segment as a porous skeletal lattice of abrasive particles positioned and arranged with interstitial spaces therein making up from 30 to 75% of the volume, placing the skeletal lattice in a mold, introducing a homogeneous material in liquid state with a melting point less than 1200° C. into the mold in order to form a support core of the abrasive tool and to penetrate the voids of the lattice sufficiently to provide a unitary construction bonding the abrasive particles with the support core.

In a preferred embodiment of the process, the abrasive particles of the skeletal lattice are diamond grains clad in a metal envelope. Particles of this kind may be obtained by applying inherently known techniques as, for example, described in U.S. Pat. No. 3,316,073, more particularly in column 2, lines 29–49, which is incorporated herein by reference. It should be noted, however, that this invention is not confined to the use of particles obtained by any particular cladding process.

Alternatively, rather than precladding the diamond grains, a mixture of abrasive particles with a metal powder in which the abrasives form approximately 1% to 50% by volume (preferably 1% to 15% by volume) may be sintered in a mold to encase the abrasive particles in the metal to yield a porous skeletal lattice structure with open pores comprising approximately 30% to 75% by volume.

Metals suitable for use in the cladding or sintering processes include cobalt, iron, bronze, nickel, titanium, copper, zinc, and mixtures and alloys thereof. Depending upon the material forming the core of the tool, synthetics suitable for use in cladding the abrasives include polyimides, polysulphones or polyether ester ketones.

If the inventive process is utilized to produce a metal abrasive tool metal, then the homogeneous material which forms the support core and bonds to the diamond-loaded structure preferably comprises cobalt, iron, zinc, tin, aluminum, magnesium, copper, silicon, or mixtures and alloys thereof. Alternatively, the process may be practiced with high performance polymers of the polyimide, polysulphone or PEEK type, polyesters or epoxies.

The support material should have a melting point higher than the service temperature of the tool and less than 1200° C., but preferably less than 950° C.

The manufacturing techniques to form the support core may include molding, casting, injecting, or pressing. Those skilled in the molding arts will understand that a wide variety of industrial practices may be utilized. When the support tool is metallic, the methods used preferably will be those of casting molten metal in sand, in chill-molds or under pressure in permanent molds. When the body of the tool is made of thermo-hardening or thermo-plastic synthetic materials, injection molding or other conventional molding methods may be preferred.

The casting of a homogeneous support metal or alloy may advantageously be carried out in a permanent mold, such as formed of refractory steel, within the meaning described in "Metals Handbook," Vol. 5, Forging and Casting, p. 265 et seq. (by the ASM Committee on production of Permanent Mold Casting), published by the American Society for Metal, which is incorporated herein by reference.

Attention is again directed to the drawings for an explanation of the inventive process. FIG. 1 illustrates an early step of forming the annular structure 2 which positions the grains of diamond 3 in a porous lattice or matrix, the configuration of which is determined by a first mold, generally indicated by the numeral 1.

More particularly, in order to form annular structure 2, particles 7 are introduced into an annular cavity 9 of a first mold 1. As shown in greater detail in FIG. 4, the particles 7 are formed from grains of diamond 3 clad by an envelope material 8. Note that any specific particle 7 may include, as shown in FIG. 4, more than one grain of diamond 3. The annular cavity 9 in which the particles 7 are thus piled is delimited on the outside by a lateral hoop 10 and above by an annular support piece 11 exerting, by virtue of its weight, a certain pressure on these particles 7. The latter are heated, under a controlled atmosphere, in an oven to the sintering temperature of the metal or alloy which comprises envelope 8 (or curing temperature if a synthetic comprises envelope 8), and thus is formed, during the subsequent cooling of mold 1, a porous rigid skeleton as shown schematically in FIG. 2.

Instead of using grains of diamond 3 preclad by an envelope material 8, as shown in FIG. 4, use may advantageously be made of a mixture of grains of diamond with a metal powder of cobalt, iron, bronze, nickel, titanium, copper, zinc, or mixtures and alloys thereof, in a proportion of 1 to 50% by volume of grains of diamond, preferably of the order of 1 to 15% by volume, relative to the volume of the metal powder. This mixture is then poured into annular cavity 9 of mold 1 which is heated until partial or surface melting of this powder is achieved. The mixture, under the weight of support piece 11, will agglomerate to form a consistent porous mass.

FIG. 3 shows, on a relatively large scale, the agglomerated metal powder 8 which encloses the grains of diamond 3 distributed beforehand in a more or less homogeneous manner in the powder.

Both in the case of a structure of particles 7 assembled by sintering, as shown in FIG. 4, and in the case of a powder premixed with the grains of diamond and agglomerated by sintering, as shown in FIG. 3, it is thus possible to obtain a structure positioning the grains of diamond in a three-dimensional manner between which pores 12 are distributed throughout.

The diamond-loaded structure 2 so formed is then placed in a second mold 4, as shown in FIG. 5, into which the homogeneous material 5, intended both to form the central support 6 and to bond to the diamond-loaded structure 2, is introduced in the liquid state.

An abrasive tool representative of our invention prepared by a process also representative of our invention is disclosed in the following specific example.

EXAMPLE

An abrasive tool was made in the form of a masonry saw blade with a diameter of 200 mm and a thickness of 3.5 mm for use on a portable saw cutting under dry conditions, i.e. without water cooling.

Grains of diamond with a grain size of between 20 and 80 Mesh (ANSI B74-16) were mixed beforehand with a proportion of 3% by volume of diamond. The mixture thus obtained was poured into the annular cavity 9 of a first mold 1 made of refractory steel (FIG. 1) with a depth of 3.5 mm and with a width of 1.25 cm, in such a way as to obtain a continuous circular band of constant thickness of this mixture. This band was then subjected to the pressure of the support piece 11 weighing 4 kg.

Next, the mold was placed in an oven and brought to a temperature of 800° C. in a nitrogen atmosphere for 30 minutes to cause agglomeration of the powder to form, by sintering, a porous structure. Following removal from the mold, the annular structure thus obtained exhibited a regularly distributed porosity of the order of 60% void, with pores being an average diameter of approximately 300 microns and a maximum diameter of approximately 1 mm.

The diamond-loaded structure 2 thus formed was then placed in a second mold 4, as shown in FIG. 5, which had previously been maintained at a temperature of 250°–300° C. and lubricated with conventional silicone-based demolding agent. This was a permanent mold made of refractory steel intended for the casting of a liquid metal or alloy under gravity. The support metal was formed from an aluminum-silicon alloy with a 7% by weight silicon content and 3% by weight added copper, which exhibited a melting point of approximately 600° C. A quantity of 25 kg of this alloy was melted in an electric oven kept at a temperature of around 670° C. The molten alloy was deoxidized and refined in such a way as to reduce its content of oxides and gaseous hydrogen for the purpose of yielding as fine a crystalline grain as possible. The molten alloy was introduced into mold 4 from a 1 kg capacity crucible through nozzle 13 fixed at the center of the mold 4 and having a 50 mm diameter opening at the entrance thereof, in such a way as to ensure perfect filling of the mold and infiltration into more or less all the pores of diamond-loaded structure 2.

Figure 6:
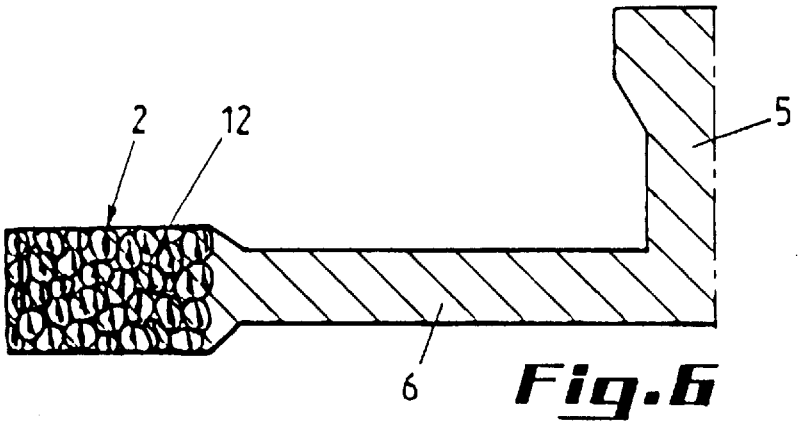
FIG. 6 is a partial sectional view of the abrasive tool in FIG. 5 shown removed from the casting mold.
Figure 7:
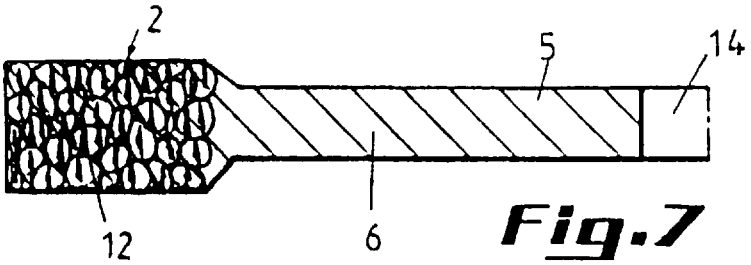
FIG. 7 is a partial sectional view of the abrasive tool in FIG. 6 shown after machining.

Approximately 300 g of the alloy filled the mold 4, and the balance (i.e. 700 g) was kept in nozzle 13 and exerted a pressure on the quantity of the alloy within the mold. The nozzle 13 containing the rest of the alloy which, following solidification, is called "dead head", was cut-off at the demolding stage from the saw blade formed as described. The demolding was carried out when the temperature of the molded tool had dropped to about 150° C. FIG. 6 shows the tool thus demolded. Then, when the tool had reached ambient temperature, it was finished by machining, notably turning and milling, and a bore 14 measuring 30 mm was drilled at its rotational axis, as shown in FIG. 7.

Figure 8:
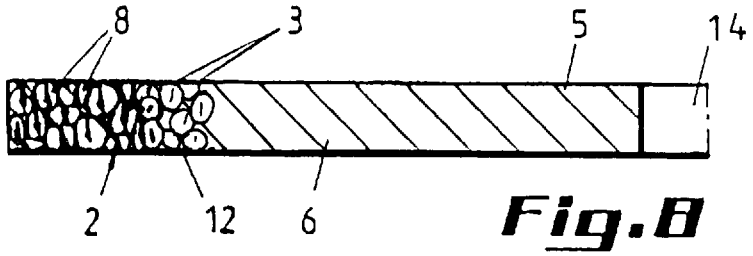
FIG. 8 is a partial sectional view of the abrasive tool in FIG. 7 after finishing and grinding to show the finished product.

Finally, the diamond-loaded annular structure 2 of the saw blade was surface-treated by grinding in order to partially expose the grains of diamond, as shown in FIG. 8.

It should be noted that the dimensions of diamond-loaded structure 2 may vary between relatively broad limits. In the case of a saw blade for masonry materials, the preference is for a thickness of 2.5–3.7 mm and a width of between 2.5 mm and 1.75 cm, depending on the desired service life of the tool.

The advantage of the process according to the invention is, among others, the fact that no pressure has to be applied to the diamond-loaded structure when it is being attached to the support, unlike conventional processes for making diamond-loaded tools.

In addition, the metal support used for fixing the diamond-loaded structure on the support is identical to that constituting the support itself, thus preventing any tension between this structure and the support. Moreover, the resulting tool has improved thermal properties over abrasive tools heretofore available.

Figure 9:
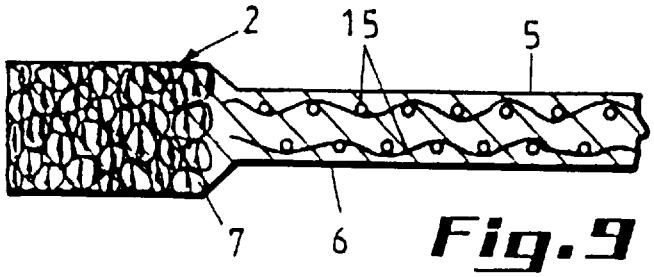
FIG. 9 is partial sectional view of an abrasive tool constructed in accordance with an alternative embodiment of the invention.

In certain cases, it may be useful to reinforce support 6 of the abrasive tool by incorporating in the latter a reinforcing material 15, as shown in FIG. 9. If a preformed reinforcing material 15, such as glass, aramide, carbon or metal lattice, is to be included for strength or rigidity of the central core, such reinforcing material will be placed in the mold 4 prior to introduction of the homogeneous material 5 so that when solidified the homogeneous material will create a effective bond with the reinforcing material.

Figure 10:
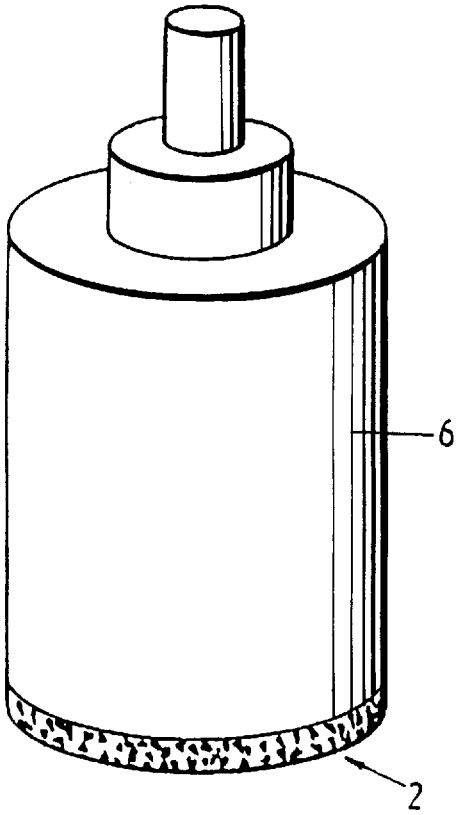
FIG. 10 is a perspective view of a drill bit exhibiting an annular structure positioning grains of diamond according to the invention.
Figure 11:
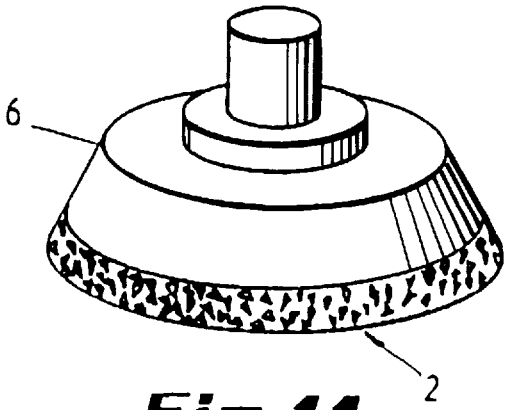
FIG. 11 is also a perspective view of a grinding wheel exhibiting a structure positioning the grains of diamond according to the invention.

The abrasive tool may also be comprised of a drill bit, as shown in FIG. 10, or of a grinding wheel or shaping tool, as shown in FIG. 11. The technique used to make these two types of abrasive tools is identical to that for making the saw blade as illustrated in FIG. 5. It, in fact, suffices simply to adapt the mold dimensions to the product configuration as desired.

In addition, in certain cases, the porosity of the diamond-loaded structure 2 may not be uniform or homogeneous but, for example, range from zero porosity, in the end area opposite that facing the support, to average porosity in the intermediate area between this zero-porosity end area and that near the support, to maximum porosity in this last area.

The porosity of the intermediate area may for example range from 10–30%, whereas the porosity of the area of the diamond-loaded structure near the support is preferably 30–75% so as to enable an effective link to be produced between this structure and the support.

The area near the support may for example form a quarter or half the total volume of the diamond-loaded structure, while the end and intermediate areas may for example exhibit an identical volume.

However, it should be noted that these areas are not generally properly delimited given that the variation in porosity from one area to the next preferably takes place in a more or less continuous manner. Thus, a porosity gradient may arise in each of these areas. For example, in the intermediate area, this porosity may be minimal on the side of the end area and maximal on the side of the area located near the support.

In yet another embodiment of the diamond-loaded structure according to the invention, the positioning of the grains of diamond may be carried out on a frame or trellis of regular mesh, for example with a diameter of 1–5 mm, made of steel, bronze or synthetic fibers. During the manufacture of the abrasive tool, such diamond positioning mesh may be shaped as necessary and placed in the tool mold. The homogeneous material may then be introduced to flow into the void space between the adjacent threads of the mesh and the diamond particles as previously indicated.

Finally, the diamond-loaded annular structure may exhibit a geometry with a grooved or fluted profile, thus enabling the rigidity of the device fastening this structure to the support to be increased by at least partial filling of the surface cavities that such a structure thus exhibits.

From the foregoing it will be seen that this invention is one well adapted to attain all end and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

We claim:

1. A rotatable abrasive tool for use at a normal service temperature during an abrading process said abrasive tool comprising: (1) a rigid skeletal lattice structure comprising grains if diamond and open pores, said open pores representing at least 30–75% of the total volume of the grains of diamond and open pores, with the average diameter of said pores being between 100 and 500 microns, with a maximum of 2 mm, and (2) a homogeneous material penetrating into at least 70% of said open pores sufficiently to form a unitary colon and having a melting point above the service temperature of tool and below 1200° C.

2. A rotatable abrasive tool for use at a normal service temperature during an abrading process, said abrasive tool comprising:

a structural body fabricated of a homogeneous material, said body having a central core adapted to be connected to a relative power source and having a consumable, outter, workpiece-contacting portion integrally formed of said homogeneous material with said central core;

a plurality of abrasives dispersed throughout said workpiece-contacting portion to grindingly remove workpiece material during rotation of said structural body; and a rigid, porous skeletal lattice formed by abrasive particles being positioned and arranged with interstitial spaces therein whereby a portion of said interstitial spaces around said abrasive particles is sufficiently filled with sad homogeneous material to hold said abrasives and to provide a unitary construction for said consumable workpiece-contacting portion of the tool.

3. The abrasive tool as in claim 2 wherein the volume of interstitial spaces represents approximately 30% to 75% of the combined volumes of interstitial spaces and abrasive particles.

4. The abrasive tool as in claim 2 wherein at least 70% of said interstitial spaces around said abrasive particles being filled with said homogeneous material.

5. The abrasive tool as in claim 2 wherein said abrasives are diamond grains clad in a metal selected from the group consisting of cobalt, iron, bronze, nickel, titanium, copper, zinc, and alloys thereof, said diamond grains comprising approximately 1% to 50% by volume of said skeletal lattice.

6. The abrasive tool as in claim 5, said diamond grains comprising approximately 1% to 15% by volume of said skeletal lattice.

7. The abrasive tool as in claim 2 wherein said abrasives include diamond grains clad in a metal selected from the group consisting of cobalt, iron, bronze, nickel, titanium, copper, zinc, and alloys thereof, said diamond grains comprising approximately 1% to 50% by volume of said skeletal lattice, and said abrasives further include abrasive dope material grains at a rate of no more than ten times the volume of the quantity of said diamond grains.

8. The abrasive tool as in claim 2, said homogeneous material having a melting point above the normal service temperature of the tool and below 1200° C.

9. The abrasive tool as in claim 8, said homogeneous material having a melting point below 950° C.

10. The abrasive tool as in claim 2, said homogeneous material being metal and being selected from the group consisting of cobalt, iron, zinc, tin, aluminum, magnesium, copper, silicon, and alloys thereof.

11. The abrasive tool as in claim 10, said homogeneous metal being an aluminum-silicon alloy containing approximately 5% to 9% silicon by weight.

12. The abrasive tool as in claim 11, said aluminum-silicon alloy containing approximately 7% silicon by weight.

13. The abrasive tool as in claim 2, said homogeneous material being synthetic and being selected from the group consisting of high performance polymers, polyesters or epoxies.

14. The abrasive tool as in claim 13, said high performance polymers being selected from the group consisting of polyimides, polysulphones and polyether ester ketones.

15. The abrasive tool as in claim 2, said abrasives being selected from the group consisting of diamond, cubic boron nitride, tungsten carbide, polycrystalline diamond, and polycrystalline cubic boron nitride.

16. The abrasive tool as in claim 15, said abrasives being diamond.

17. A rotatable abrasive tool for use at a normal service temperature during an abrading process, said abrasive tool comprising:

a structural body fabricated of a homogeneous material, said body having a central core adapted to be connected to a rotative power source and having a consumable, outer, workpiece-contacting portion integrally formed of said homogeneous material with said central core; and a rigid, porous skeletal lattice formed by abrasive particles being positioned and arranged with interstitial spaces therein whereby a portion of said interstitial spaces around said abrasive particles is sufficiently filled with said homogeneous material to hold said abrasives and to provide a unitary construction for said consumable workpiece-contacting portion of the tool, said abrasives being clad in a high performance polymer being selected from the group consisting of polyimides, polysulphones and polyether ester ketones, and said cladding polymer having a melting point higher than the melting point of said homogeneous material.

18. The abrasive tool as in claim 17, said homogeneous material having a melting point above the normal service temperature of the tool and below 1200° C.

19. The abrasive tool as in claim 18, said homogeneous material having a melting point below 950° C.

20. The abrasive tool as in claim 19, said homogeneous material being metal and being selected from the group consisting of cobalt, iron, zinc, tin, aluminum, magnesium, copper, silicon, and alloys thereof.

21. The abrasive tool as in claim 20, said homogeneous metal being an aluminum-silicon alloy containing approximately 5% to 9% silicon by weight.

22. The abrasive tool as in claim 19, said homogeneous material being synthetic and being selected from the group consisting of high performance polymers, polyesters or epoxies.

23. The abrasive tool as in claim 22, said high performance polymers being selected from the group consisting of polyimides, polysulphones and polyether ester ketones.

24. The abrasive tool as in claim 17, said abrasives being selected from the group consisting of diamond, cubic boron nitride, tungsten carbide, polycrystalline diamond, and polycrystalline cubic boron nitride.

25. The abrasive tool as in claim 24, said abrasives being diamond.

26. The abrasive tool as in claim 17 wherein the volume of interstitial spaces represents approximately 30% to 75% of the combined volumes of interstitial spaces and abrasive particles.

27. The abrasive tool as in claim 26 wherein at least 70% of said interstitial spaces around said abrasive particles being filled with said homogeneous material.

28. The abrasive tool as in claim 17, said central core further including a preformed reinforcing material positioned within said homogeneous material for added strength characteristics.

* * * * *